US006629654B2

(12) United States Patent
Neely et al.

(10) Patent No.: US 6,629,654 B2
(45) Date of Patent: Oct. 7, 2003

(54) SECURE DISPOSAL SYSTEM FOR ARTICLES

(75) Inventors: Phillip K. Neely, Terre Haute, IN (US); Dan Henderson, Avon, IN (US)

(73) Assignees: Sony Corporation, Tokyo (JP); Digital Audio Disc Corporation, Terre Haute, IN (US)

( * ) Notice: Subject to any disclaimer, the term of this patent is extended or adjusted under 35 U.S.C. 154(b) by 316 days.

(21) Appl. No.: 09/886,813

(22) Filed: Jun. 21, 2001

(65) Prior Publication Data

US 2002/0195508 A1 Dec. 26, 2002

(51) Int. Cl.[7] ..... B02C 19/12
(52) U.S. Cl. ..... 241/30; 241/101.5; 241/277
(58) Field of Search ..... 241/30, 101.5, 241/277, 101.74, 101.741, 100

(56) References Cited

U.S. PATENT DOCUMENTS 5,186,397 A * 2/1993 Orlando ..... 241/23
5,871,162 A * 2/1999 Rajewski ..... 241/100

* cited by examiner

*Primary Examiner*—Mark Rosenbaum
(74) *Attorney, Agent, or Firm*—Wood, Herron & Evans, L.L.P.

(57) ABSTRACT

A secure disposal system for articles having a movable enclosure that is fully enclosed except for an opening to receive articles. The movable enclosure has a releasable lock for automatically locking a cover in a closed position on the movable enclosure. A transfer device automatically unlocks the cover of the movable enclosure in response to the transfer device mechanically engaging the movable enclosure. The transfer device transfers the enclosure to a position and orientation permitting the cover of the enclosure to fall open and the articles to drop from the enclosure. An article destroyer is located adjacent the transfer device, receives the articles dropping from the movable enclosure and destroys their functionality.

23 Claims, 5 Drawing Sheets

SECURE DISPOSAL SYSTEM FOR ARTICLES

FIELD OF THE INVENTION

This invention relates to material handling and more particularly, to a system for handling and disposing of articles, for example, optical discs.

BACKGROUND OF THE INVENTION

In many production environments, articles are often produced in batches for particular customers. Although a customer orders a desired quantity of articles, in some applications, it is normal practice to run a batch of articles that is in excess of the desired quantity. Thus, as the articles proceed through the various steps of the production process, if lesser quality or scrap articles are produced, the batch will still have a net yield of articles that is sufficient to ship the desired quantity to the customer. Further, most often, the batch will yield a quantity of good, high quality articles that is in excess of the desired quantity, and those excess articles potentially have full market value. Depending on the articles, their unauthorized distribution may potentially create a liability for the manufacturer. For example, if the articles are optical discs that contain copyrighted music and/or movies, an unauthorized distribution or sale of such excess production optical discs may be illegal. Therefore, if the excess production discs cannot be sold to the customer, the manufacturer normally, as a minimum, destroys the readability of the optical discs prior to disposal or recycling.

However, there are no known systems for securely handling excess optical disc production from the time that it has been produced until the time that it is initially processed for recycling or disposal. In known manufacturing environments, there are minimal or no facilities for physically securing excess optical discs while they are being transported from a production station to a machine that destroys their readability. Thus, there are opportunities for the optical discs to leak, that is, be removed, from the production facilities. Further, with some batches, the number of excess optical discs is significant, and therefore, their loss represents a loss of a significant value.

Consequently, there is a need for a material handling system for articles of excess production that is more secure, reliable and automated than known systems.

SUMMARY OF THE INVENTION

The present invention provides a simple and reliable system for securely handling and destroying the functionality of articles. The system of the present invention automatically locks access to the articles during their collection, thereby securing the articles during their transportation. Further, the system of the present invention automatically unlocks access to the articles immediately prior to their destruction. Thus, the secure disposal system of the present invention is especially useful in an environment in which optical discs containing copyrighted material are produced. The secure disposal system of the present invention has the advantages of first, efficiently handling optical discs identified for destruction and, second, reducing a potential for liability caused by an unauthorized distribution or sale of such optical discs.

According to the principles of the present invention and in accordance with the preferred embodiments, the invention provides a secure disposal system for articles having a movable enclosure that is fully enclosed except for an opening to receive articles. The movable enclosure has a releasable lock for automatically locking a cover in a closed position on the movable enclosure. A transfer device automatically unlocks the cover of the movable enclosure in response to the transfer device mechanically engaging the movable enclosure. The transfer device transfers the enclosure to a position and orientation permitting the cover of the enclosure to fall open and the articles to drop from the enclosure. An article destroyer is located adjacent the transfer device, receives the articles dropping from the movable enclosure and destroys their functionality.

In one aspect of the invention, the movable enclosure has a first member; and the transfer device has a lift arm. The releasable lock is unlocked as the first member receives the lift arm, thereby releasing the cover from the enclosure.

In another aspect of the invention, the movable enclosure is a wheeled cart and the transfer device includes a rotary drive. The rotary drive inverts the wheeled cart, thereby by allowing the cover to fall open and the articles to drop into the article destroyer.

In another embodiment of the invention, a method is provided for automatically locking a cover of a movable enclosure upon the cover closing over the movable enclosure. As the movable enclosure is moved onto a transfer device, the cover is automatically unlocked; and thereafter, the transfer device is operated to transfer the articles from the movable enclosure into an article destroyer. Thus, the articles are locked in the movable enclosure until the movable enclosure is moved onto the transfer device, and the articles are discharged into the article destroyer immediately after the cover of the movable enclosure is automatically unlocked.

These and other objects and advantages of the present invention will become more readily apparent during the following detailed description taken in conjunction with the drawings herein.

DETAILED DESCRIPTION OF THE INVENTION

Figure 1:
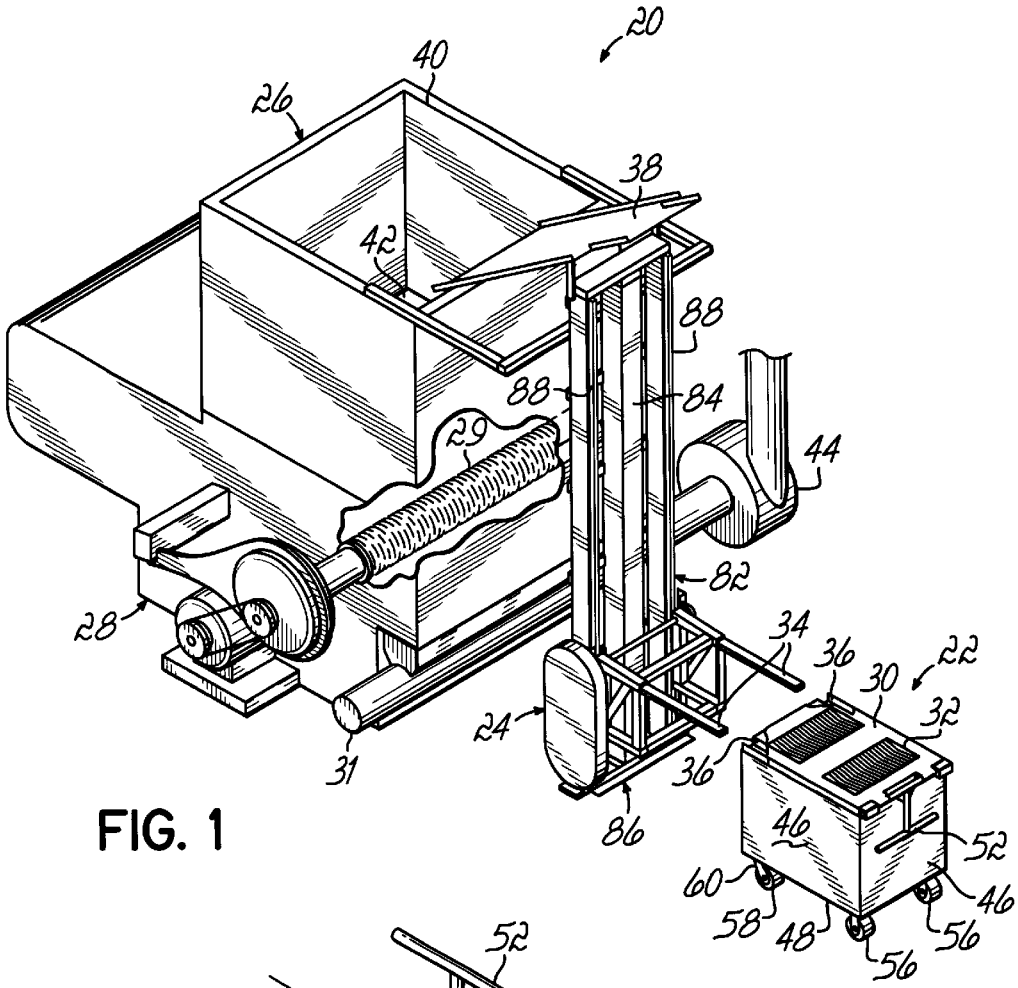
FIG. 1 is a perspective view of the secure disposal system for articles in accordance with the principles of the present invention.

Referring to FIG. 1, a secure disposal system 20 for articles is comprised of a mobile cart 22, a transfer device 24, an article accumulator or hopper 26 and an article destroyer 28. One example of an article destroyer 28 is a rotary grinder model RG 42EW commercially available from ReTech Industries, Inc. of High Point, N.C. Such a rotary grinder 28 has a cutting or grinding tool 29 that grinds the articles or optical discs into small pieces that drop into a collector 31. The ground optical disc material in the collector 31 is transported away from the article disposal system 20 by a pneumatic transfer system 44. In many manufacturing environments, scrap articles are produced in the normal course of production. In other environments, for example, in the production of optical discs containing audio and video material, overrun production is common. The secure disposal system 20 of FIG. 1 is especially useful for collecting and destroying nondefective, good articles such as optical discs that have a commercial value and the unauthorized distribution and sale of which may be illegal.

The cart 22 has a hinged cover or lid 30 that is normally locked or secured in its illustrated, closed position. The cover 30 has slots or openings 32 that permit articles, in this example, optical discs, to be loaded into the cart 22. The cart 22 is manually or automatically moved to various production stations, and overproduction and/or scrap optical discs are inserted through the openings 32 and dropped into the cart 22. After the optical discs have been loaded into the cart 22, the automatic securing or locking of the cover 30 to the cart 22 prohibits removal of the optical discs. Thus, the cart 22 is a secure facility for storing the optical discs therein.

At appropriate times, the cart 22 is moved into juxtaposition with the transfer device 24. The transfer device 24 has a pair of lift arms 34 that are sized to be received by hollow members or rails 36 on the cart 22. As will subsequently be described in detail, insertion of the arms 34 into the hollow rails 36 automatically unlocks the cover 30, thereby permitting the cover 30 to pivot freely with respect to the cart 22. After the cart 22 is mounted on, or coupled engaged with, the transfer device 24, the transfer device 24 raises the lift arms 34 and the cart 22. The lift arms 34 and cart 22 are then rotated to a position illustrated in FIG. 5. With the cart 22 in its inverted position, the cover 30 falls open; and the articles in the cart 22 drop onto a chute or ramp 38 and then, drop through a first opening 40 of the article accumulator or hopper 26. The articles then pass through a second hopper opening 42 and into a chamber or throat of the article destroyer 28.

Figure 2:
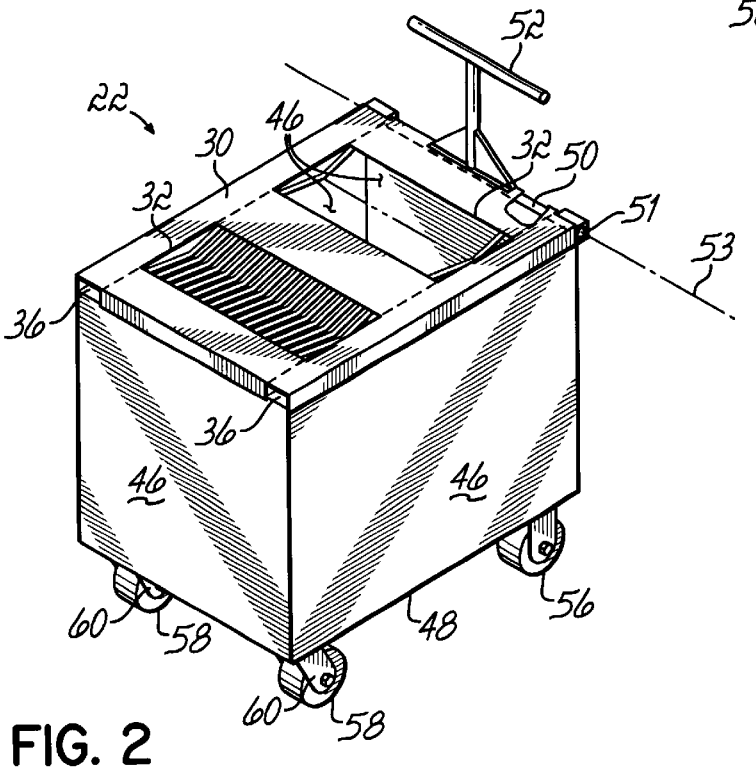
FIG. 2 is a perspective view of a wheeled cart used with the secure disposal system for articles of FIG. 1.

Referring to FIG. 2, the cart 22 is normally a rectangular enclosure having four sidewalls 46 and a bottom wall 48. The enclosure of the cart 22 may be made of any suitable material, for example, welded aluminum sheets. The cover 30 forms a top wall and is pivotally connected to one of the walls 46 by a hinge formed by a pair of sleeves 50 that are rigidly attached, for example, by adhesives, fasteners, welding, etc., to the underside of the cover 30 along its rear edge. The sleeves 50 are rotatably mounted on a shaft 51, so that the cover 30 rotates freely with respect to a generally horizontal pivot axis 53. The ends of the shaft 51 are fixed or secured within the ends of the siderails 36, for example, by adhesives, fasteners, welding, etc. A handle 52 is also rotatably mounted on the shaft 51 and it also rotates freely with respect to the pivot axis 53. Thus, when released, the handle 52 normally rests in a lower-most position against the rear side of the cart 22. The handle 52 is held in its lower-most position by a magnet (not shown) on the cart rear side, so that it does not move without being gripped by the user of the cart 22. Thus, the position of the handle 52 illustrated in FIG. 2 is only possible if the handle 52 is being supported in that position by a user of the cart 22. The handle 52 is made of any suitable rigid material, for example, welded aluminum tubing. When lifted to the illustrated position, the handle 52 can be used to push and steer the cart 22. The cart 22 further has a pair of rear wheels 56 that are mounted to the cart 22. A pair of front wheels 58 are mounted to respective casters 60 that are, in turn, are pivotally attached to the cart 22 in a known manner.

Figure 3A:
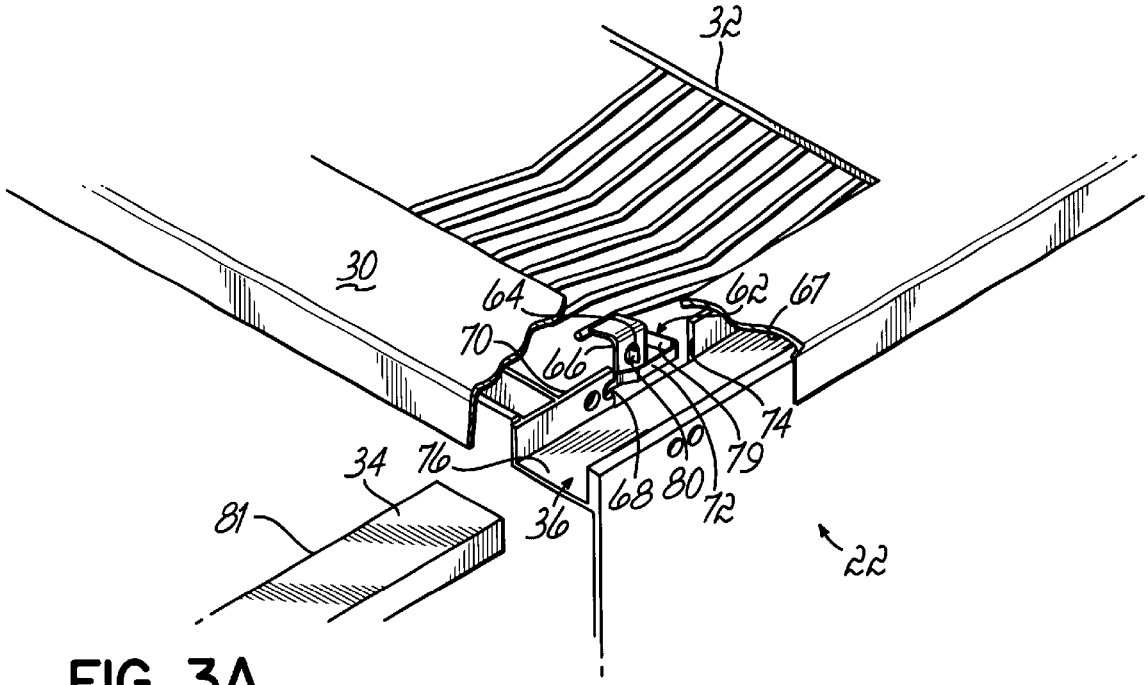
FIG. 3A is a partial perspective view illustrating a releasable cover lock for the wheeled cart of FIG. 2 in its locked position.

Referring to FIG. 3A, the cover 30 is secured to the cart 22 by a releasable latch 62 engaged in a hole 64 of a keeper 66. The keeper 66 is welded or otherwise rigidly connected to an underside 67 of the cover 30. The latch 62 is normally made from a resilient, metal spring material and has a first, proximal end 68 welded or otherwise rigidly connected to a side surface 70 of the hollow rail member 36. The latch 62 has a body portion 72 that bends in a first direction and projects inward through a cutout or opening 74 in the sidewall 70 of the hollow rail 36. The body portion 72 thus extends into the cavity 76 of the hollow rail 36.

A second, distal end 78 of the latch 62 is generally J-shaped and has a longer leg 79 that extends in a second direction opposite the first direction, that is, outward from the opening 74. A shorter leg 80 extends back in the first direction through a hole 64 of a keeper 66. The positioning of the shorter leg 80 of the latch 62 in the hole 64 of the keeper 66 locks or latches the cover 30 in a closed position on the cart 22. Therefore, the cover 30 cannot be lifted, and articles or optical discs in the cart 22 are secured from being removed therefrom. Although FIG. 3A illustrates the cover latch 62 or locking mechanism in one of the hollow rails 36, as will be appreciated, the cover latch 62 may be used in either or both of the hollow rails 36.

Figure 4:
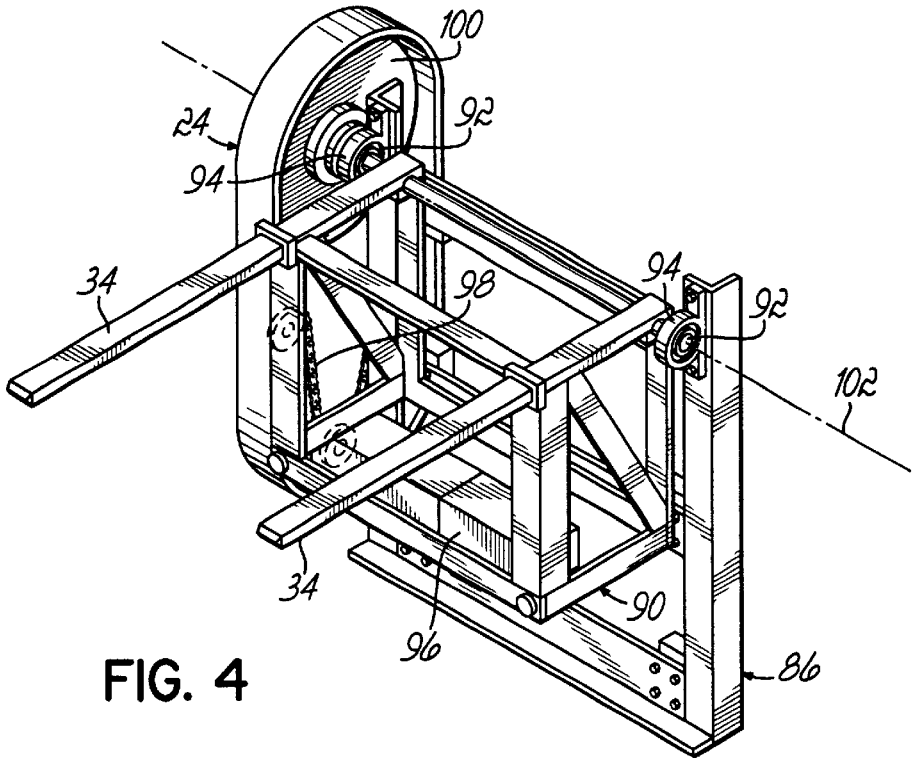
FIG. 4 is a perspective view of a portion of the transfer device illustrated in FIG. 1.

Referring to FIG. 1, the transfer device 24 has a frame 82 that supports a linear drive, for example, a rodless air cylinder 84. A fork assembly 86 supports the pair of lift arms 34 and is rigidly connected to a movable portion (not shown) of the cylinder 84. The fork assembly 86 is also mounted on a pair of guiderails 88 that guide its motion in a generally vertical direction. Referring to FIG. 4, the lift arms 34 of the fork assembly 86 are rigidly connected to a frame 90. The frame 90 is rotatably connected to the fork assembly 86 by means of a pair of axles or spindles 92 that are mounted inside bearing blocks 94.

A rotary drive, for example, an electric motor, 96 is connected to the frame 90 by mechanical drive, for example, a looped chain 98 and gear 100. The gear 100 is substantially larger than a gear (not shown) on an output shaft of the motor 96 in order to provide the motor 96 with a large mechanical advantage. The rotary drive 96 may be an electric servomotor or any other appropriate electric or hydraulic motor and drive that is capable of providing an angular motion. The chain and gear drive may be replaced by a toothed belt and pulley or any other mechanical linkage that is sufficiently strong to rotate the cart 22 as will be described. In one application, the cart weighs about 100 pounds and has a load carrying capacity of about 150 pounds. Operating the rotate motor 96 is effective to rotate the fork assembly 86 and cart 22 through an angular displacement about an axis of rotation 102. The exact magnitude and limits of the angular displacement of the fork assembly 86 are variable and normally programmable and/or controlled by proximity switches, for example, limit switches, either external or internal to the motor 96 in a known manner. However, in order to properly empty the cart 22, the angular displacement of the fork assembly is about 180°.

Figure 6:
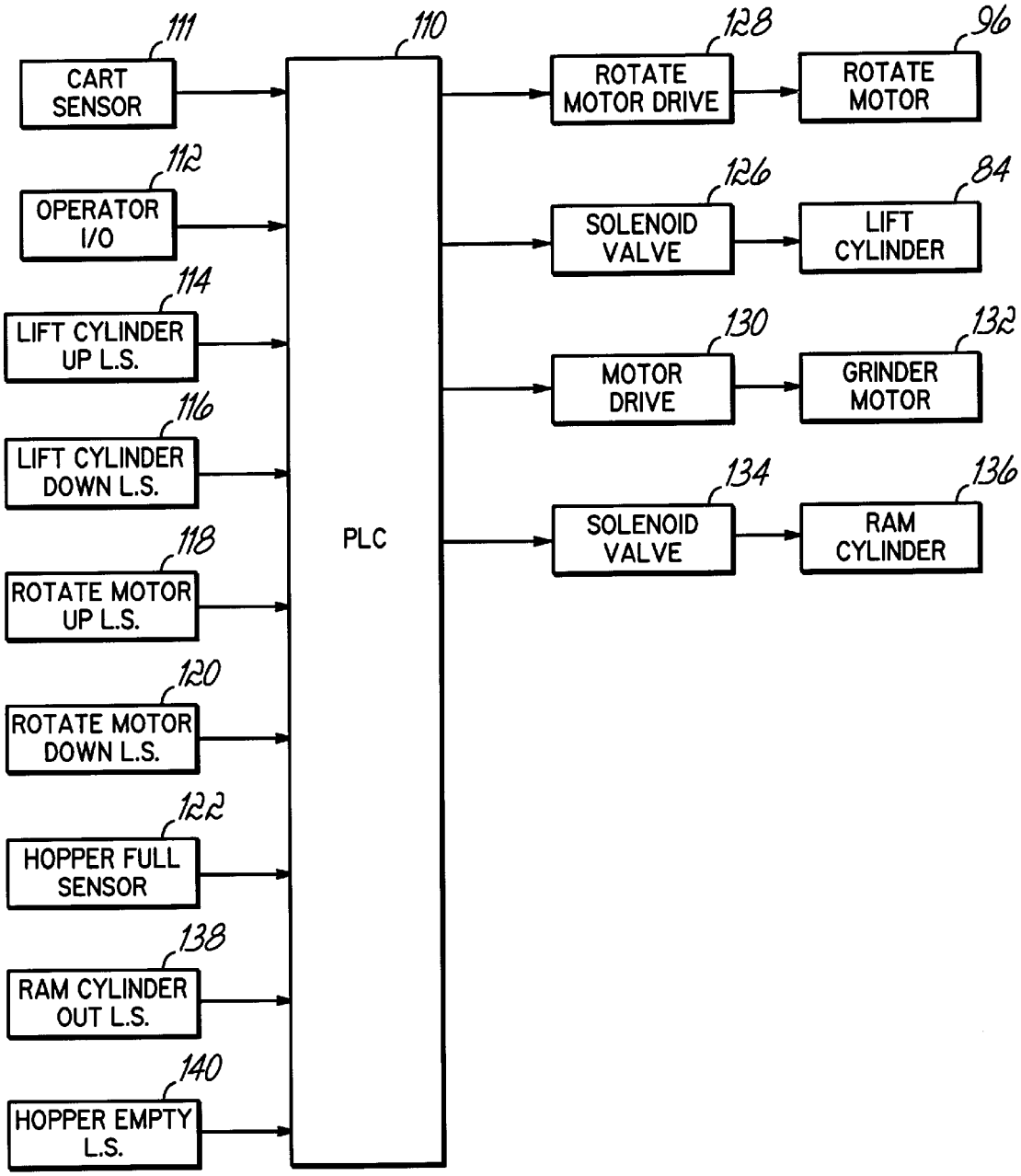
FIG. 6 is a schematic block diagram of a control used to operate the secure disposal system of FIG. 1.

Referring to FIG. 6, the secure disposal system is controlled by a programmable logic controller ("PLC") 110. The controller 110 has inputs provided by operator input/output devices ("I/O") 112, for examples, pushbuttons, a keyboard, touchscreen or other known input devices. In addition, the PLC 110 has inputs from limit switches 114, 116 that are provided with the lift cylinder 84. The limit switches 114, 116 produce outputs in response to the lift cylinder being in its up and down positions, respectively. The rotate motor 96 also has limit switches 118, 120 that provide outputs to the PLC 110 in response to the rotate motor being through its angular displacement. Further, the PLC 110 receives input signals from a sensor 122 that detects when the hopper 26 is full. Other limit switches 138, 140 indicate when the ram cylinder is fully extended and the hopper 40 is full. As will be appreciated, the operation of the article destroyer may require other devices as well as other input and output signals; however, such devices and signals are not necessary for a full understanding of the claimed invention and will not be described herein.

In use, a user grabs and lifts the handle 52 (FIG. 2) of the wheeled cart 22 from its magnetically latched rest position and uses the handle 52 to move the cart 22 to desired locations, for example, different processing stations, within a production environment. Articles to be disposed of, for example, scrap optical discs and/or overruns of printed optical discs, are placed in the openings or slots 32 of the cover 30. When the cart 22 either contains, or is filled with, optical discs, the cart 22 is then moved to the transfer device 24 shown in FIG. 1.

Figure 3B:
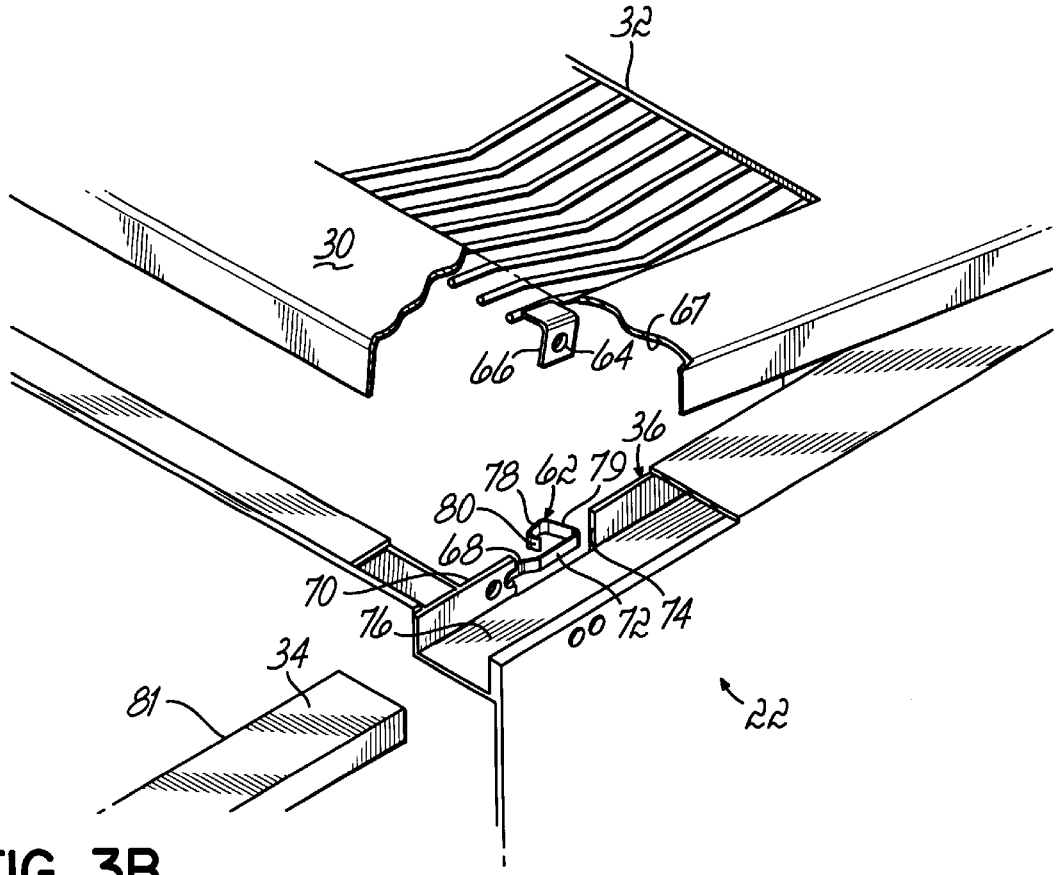
FIG. 3B is a partial perspective view illustrating a releasable cover lock of FIG. 3A in its unlocked position.

The cart 22 is maneuvered so that the pair of hollow rails begins to slide over the pair of lift arms. Referring to FIG. 3B, as a lift arm 34 slides into the opening 76 of a hollow rail 36, a side surface 81 of a lift arm 34 contacts and pushes against the main body 72 of the latch 62. The side surface 81 pushes the latch 62 in the second direction outward through the opening 74 of the hollow rail 36. Simultaneously, the shorter leg 80 of the latch 62 moves in the second direction out of the hole 64 of the keeper 66, thereby automatically unlocking or releasing the cover 30 from the cart 22. Thus, when the cart 22 is properly positioned on the arms 34 of the transfer device 24, the cover 30 can be pivoted and opened with respect to the cart 22.

Figure 7:
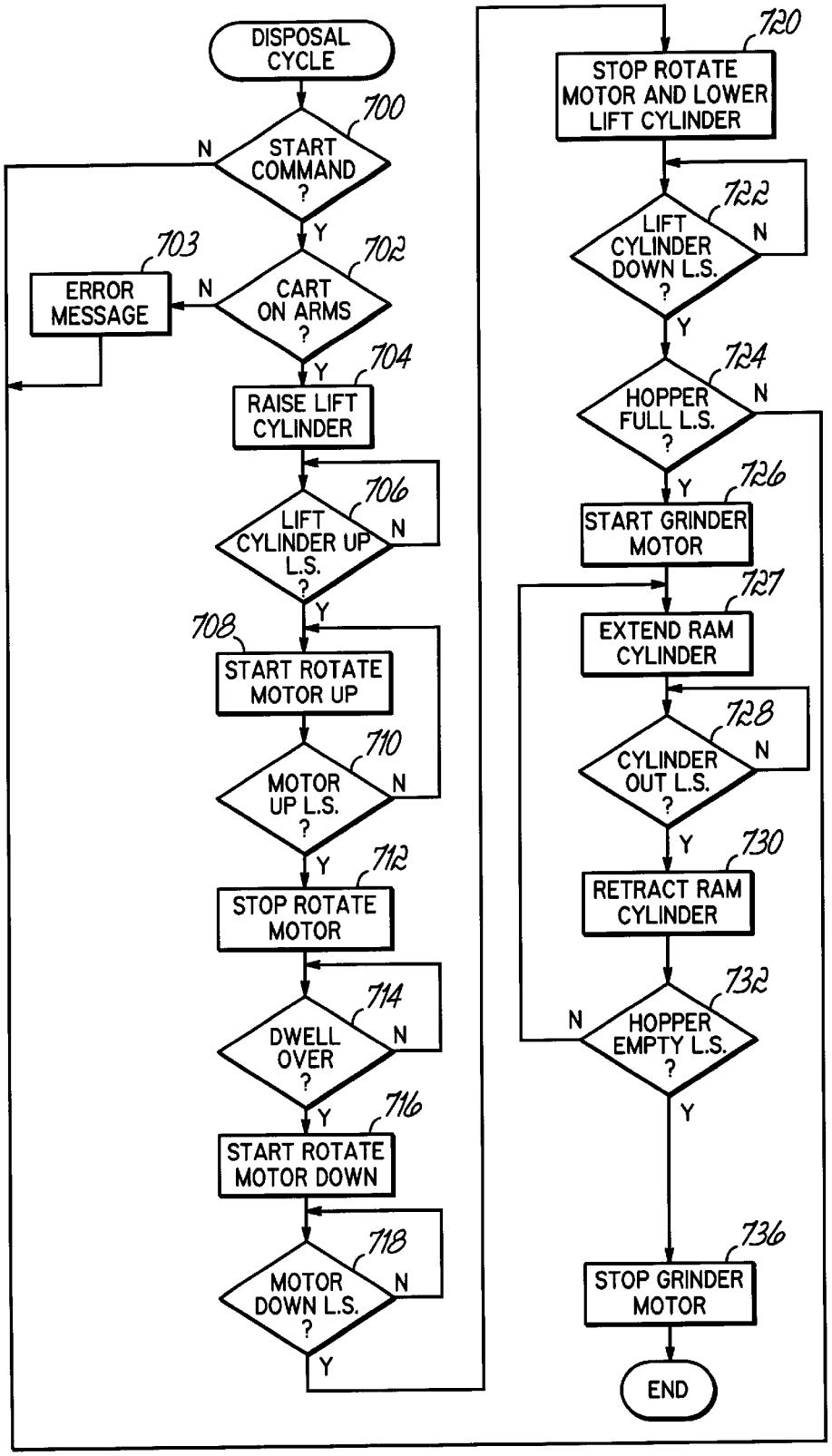
FIG. 7 is a flowchart of a cycle of operation executed by the control of FIG. 6.

Next, the operator I/O 112 (FIG. 6) is used to provide a start command that initiates the disposal cycle illustrated in FIG. 7. Upon receiving the start command at 700, the PLC 110 then, at 702, checks the state of a cart sensor 111 (FIG. 6) associated with the fork assembly 86. The cart sensor 111 may be any device that is able to detect that the cart 22 is located at its proper position on the arms 34. Thus, the cart sensor 111 may be an IR sensor or a proximity switch, for example, a limit switch, located on the frame 90 (FIG. 4) of the fork assembly. If the cart sensors 111 do not detect the cart 22 on the lift arms 34, the PLC 110 provides an error message at 703 to the operator via the operator I/O 112.

If the cart 22 is present on the arms, the PLC 110 then, at 704, provides a command signal to a solenoid valve 126 that ports fluid to the lift cylinder 84 in a direction causing the lift cylinder 84 to raise the fork assembly 86 and the cart 22. A lift cylinder up limit switch 114 provides an input signal to the PLC 110 in response to the lift cylinder reaching its fully raised position. The PLC at 706, detects the raised position and then, at 708, provides an output command to a motor drive 128 that, in turn, operates the motor 96 in a direction to rotate the fork assembly 86 and cart 22 over the hopper 26 in a counterclockwise direction as illustrated in FIG. 5.

The PLC 110 detects, at 710, an output signal from a proximity sensor, for example, rotate motor up limit switch 118, when the rotate motor 96 reaches its desired position. The PLC 110 then, at 712, commands the motor drive 128 to stop the motor 96. As the cart 22 rotates counterclockwise, the cart 22 is inverted; and the cover 30 falls open; and optical discs drop from the cart 22, slide down chute 38 and drop through first opening 40 into the hopper 26. To allow for that activity, PLC 110 utilizes an internal timer to effect a dwell or delay and, at 714, checks to determine when that time period expires.

Figure 5:
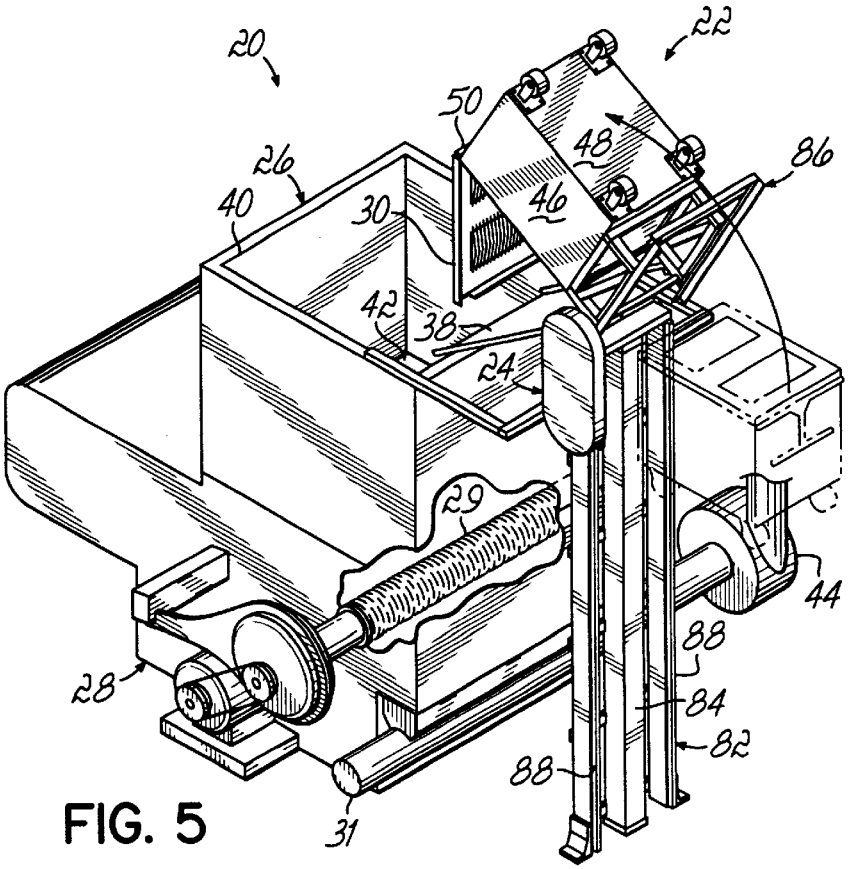
FIG. 5 is a perspective view of the article disposal system of FIG. 1 illustrating the wheeled cart being lifted by the transfer device to a position and orientation permitting the articles therein to be discharged.

When the expiration of the dwell time is detected, the PLC 110, at 716, provides command signals to the motor drive 128 causing it to operate the motor 96 in the opposite direction, thereby rotating the cart 22 generally clockwise as viewed in FIG. 5. At 718, a proximity sensor, for example, a motor down limit switch, 120 provides an input signal representing the original, generally horizontal and upright position of the cart 22; and at 720, the PLC 110 commands the motor 96 to stop. Simultaneously, the PLC 110 commands the solenoid drive 126 to reverse its state, thereby porting fluid to the lift cylinder 84 in a direction causing the lift cylinder to lower. A lift cylinder down limit switch 116 provides an input signal that is detected by the PLC 110 at 722.

At this point, the cart 22 is again resting on the floor and can be moved off of the arms 34 by using the handle 52. As the hollow rails 36 slide off of the arms 34, referring to FIG. 3A, the side 81 of the arm 34 is moved out of contact with the main body 72 of the latch 62. The resiliency of the latch 62 causes the latch 62 to move in the first direction back through the opening 74 and back into the cavity 76 of the hollow rail 36. In doing so, the smaller end 80 of the latch 62 again moves back into the hole 64 of the keeper 66; and the cover is automatically locked or secured in its closed position on the cart 22.

Thereafter, the PLC 110, at 724, checks the state of the hopper full limit switch 122. If the hopper 26 is not full, subsequent cart loads of optical discs are loaded into the hopper until the sensor 122 detects that the hopper 26 is full. At 726, the PLC 110 provides an output to the motor drive 130 commanding a grinder motor 132 to start. Simultaneously, at 727, the PLC 110 provides an output signal to a solenoid valve 134 commanding a ram cylinder 136 in the hopper 26 to begin to extend. Thus, the grinder 28 is operating to grind up the optical discs that are in the hopper 26. Further, the operation of the ram continues to feed optical discs into the shredder. A ram cylinder out limit switch 138 provides a signal to the PLC 110 indicating that the ram is fully extended. That signal is detected at 728, and at 730, the PLC 110 provides a signal to the solenoid valve 134 causing it to reverse its state and port fluid to the ram cylinder 136 in a direction causing the ram cylinder to retract. If, at 732, the PLC 110 determines that the hopper 40 is not empty, the process of steps 727–730 is repeated until all of the discs in the hopper 40 have been destroyed. Upon the PLC 110 detecting, at 732, an output signal from a hopper empty limit switch 140 indicating that the hopper is empty, the PLC 110 then, at 736, provides an output signal to the motor drive 130 commanding the grinder motor 132 to stop. The ground pieces of the optical discs are transported by the pneumatic transfer system 44 to another location for further processing, for example, recycling.

The present invention provides a simple and reliable system for securely handling and destroying the functionality of articles. The system automatically locks a cover of an article container, thereby maintaining the articles secure during their collection and transportation. Further, the system automatically unlocks the cover of the container immediately prior to their destruction. Thus, the secure system described herein is especially useful in an environment in which optical discs containing copyrighted material are produced. The secure disposal system described herein has the advantages of first, efficiently handling optical discs identified for destruction and, second, reducing a potential for liability caused by an unauthorized distribution or sale of such optical discs.

While the invention has been illustrated by the description of one embodiment and while the embodiment has been described in considerable detail, there is no intention to restrict nor in any way limit the scope of the appended claims to such detail. Additional advantages and modifications will readily appear to those who are skilled in the art. For example, in the described embodiment, the article destroyer is described as a grinder with a rotating cutting tool. As will be appreciated, the article destroyer may be any other piece of equipment that is capable of either, destroying only the functionality of the articles or, fully destroying the whole article.

Therefore, the invention in its broadest aspects is not limited to the specific details shown and described. Consequently, departures may be made from the details described herein without departing from the spirit and scope of the claims which follow.

What is claimed is:

1. A secure disposal system for articles comprising:

a movable enclosure, the enclosure being fully enclosed except for an opening adapted to receive articles and a cover, the movable structure further comprising a releasable lock for automatically locking the cover in a closed position on the movable enclosure;

a transfer device automatically unlocking the cover of the movable enclosure in response to the transfer device being mechanically engaged with the movable enclosure, the transfer device transferring the enclosure to a position and orientation permitting the cover of the enclosure to fall open and articles to drop from the enclosure; and an article destroyer located adjacent the transfer device, the article destroyer receiving the articles dropping from the movable enclosure and destroying a functionality of the articles.

2. The secure disposal system for articles of claim 1 wherein the transfer device further comprises:

a lift arm; and a rotary drive mechanically connected to the lift arm, the lift arm being rotatable by the rotary drive with respect to an axis of rotation.

3. The secure disposal system for articles of claim 2 wherein the enclosure further comprises a first member, the lift arm being receivable by the first member, such that the first member, lift arm and enclosure are rotatable by the rotary drive.

4. The secure disposal system for articles of claim 3 further comprising a resilient member having a first portion disposed adjacent the first member and a second portion disposed adjacent the cover, the second portion of the resilient member being movable between a first position preventing the cover from opening and a second position permitting the cover to open.

5. The secure disposal system for articles of claim 4 wherein the resilient member is disposed in the first member at a location permitting the first lift arm to move the second portion of the resilient member to the second position upon the first member receiving the first lift arm, so that as the enclosure is rotated by the rotary drive, the cover falls to an open position, thereby by allowing the articles in the enclosure to drop therefrom.

6. The secure disposal system for articles of claim 5 further comprising:

a pair of lift arms on the transfer device; and a pair of members, each of the pair of members receiving the pair of lift arms, such that the pair of members, the pair of lift arms and the enclosure are rotatable by the rotary drive.

7. The secure disposal system for articles of claim 6 wherein the transfer device further comprises a linear drive for moving the pair of hollow members and the rotary drive in a generally vertical direction.

8. The secure disposal system for articles of claim 7 wherein the article destroyer further comprises:

a cutting tool; and an article feeder for moving the articles toward the cutting tool.

9. The secure disposal system for articles of claim 1 further comprising a hinge pivotally connecting the cover to the enclosure.

10. The secure disposal system for articles of claim 1 wherein the movable enclosure further comprises a wheeled cart.

11. The secure disposal system for articles of claim 1 wherein the article destroyer comprises an article shredder.

12. A secure disposal system for optical discs comprising:

a wheeled cart comprising an enclosure having a lockable cover and at least one opening adapted to receive optical discs, a pair of rails, a releasable locking element located adjacent at least one of the rails, the locking element securing the cover in a closed position;

a transfer device comprising a pair of lift arms, each of the lift arms being receivable by a different one of the pair of rails, the locking element unlocking the cover from the wheeled cart in response to one of the lift arms being received by one of the rails, and a drive mechanism operably connected to the pair of lift arms to pivot the pair of lift arms between first and second positions, such that when the pair of lift arms is received by the pair of rails and the drive mechanism pivots the pair of lift arms and the cart to the second position, the cover falls opens and the optical discs drop from the enclosure of the cart; and an optical disc destroyer located adjacent the transfer device, the optical disc destroyer receiving optical discs from the enclosure of the wheeled cart and destroying a functionality of the optical discs.

13. The secure disposal system for optical discs of claim 12 wherein each of the pair of rails has a longitudinal cavity shaped to receive one of the lift arms.

14. The secure disposal system for optical discs of claim 12 wherein each of the pair of rails has a longitudinal cavity with a cross-sectional shape geometrically similar to a cross-sectional shape of a respective one of the lift arms, such that the respective one of the lift arms readily slides into the longitudinal cavity.

15. The secure disposal system for optical discs of claim 12 wherein the releasable locking element further comprises a resilient member having a first portion disposed adjacent one of the rails and a second portion being movable between a first position preventing the cover from opening and a second position permitting the cover to open.

16. The secure disposal system for optical discs of claim 15 wherein the first portion of the resilient member is disposed inside the longitudinal cavity of one of the pair of rails, the first portion of the resilient member being moved by a respective lift arm upon the rail receiving the respective lift arm, whereby motion of the first portion of the resilient member causing the second portion of the resilient member to move to the second position, thereby permitting the cover to move to the open position as the enclosure is rotated by the rotary drive and thus allowing the optical discs in the enclosure to discharge into the hopper.

17. The secure disposal system for optical discs of claim 12 further comprising a second releasable locking element, each of the releasable locking elements further comprising a resilient member having a first portion disposed adjacent one of the rails and a second portion being movable between a first position preventing the cover from opening and a second position permitting the cover to open.

18. The secure disposal system for optical discs of claim 12 wherein the transfer device further comprises a cylinder drive for moving the pair of rails, the pair of lift arms and the rotary drive in a generally vertical direction.

19. The secure disposal system for optical discs of claim 18 wherein the optical disc destroyer further comprises:

a cutting tool; and an optical disc feeder for moving the optical discs toward the cutting tool.

20. The secure disposal system for optical discs of claim 19 wherein the optical disc destroyer comprises an optical disc grinder.

21. The secure disposal system for articles of claim 12 further comprising a hopper located proximate the transfer device, the hopper having a first opening for receiving the optical discs dropped from the enclosure, and a second opening through which optical discs pass to the optical disc destroyer.

22. A method of securely disposing of articles comprising:

providing a movable enclosure, the movable enclosure being fully enclosed except for an opening adapted to receive articles and a lockable cover;

automatically locking the cover of the movable enclosure upon the cover closing over the opening of the movable enclosure;

inserting articles into the opening;

moving the movable enclosure onto a transfer device;

automatically unlocking the cover in response to the movable enclosure being moved onto the transfer device; and operating the transfer device to automatically transfer the articles from the movable enclosure into an article destroyer, the articles being locked in the movable enclosure until the movable enclosure is moved onto the transfer device, and the articles being disposed into the article destroyer after the cover of the movable enclosure is automatically unlocked.

23. The method of claim 22 further comprising:

removing the movable enclosure from the transfer device; and automatically locking the cover in response to the movable enclosure being moved off of the transfer device.

* * * * *

UNITED STATES PATENT AND TRADEMARK OFFICE

CERTIFICATE OF CORRECTION

PATENT NO. : 6,629,654 B2
DATED : October 7, 2003
INVENTOR(S) : Neely et al.

It is certified that error appears in the above-identified patent and that said Letters Patent is hereby corrected as shown below:

Column 2,
Lines 19-20, read "thereby by allowing" and should read -- thereby allowing --.

Column 4,
Line 6, reads "that are, in turn, are pivotally" and should read -- that are, in turn, pivotally --.

Column 5,
Line 2, reads "for examples" and should read -- for example --.

Column 6,
Line 15, reads "limit switch, 120 provides" and should read -- limit switch 120, provides --.

Column 7,
Line 12, reads "restrict nor in" and should read -- restrict or in --.
Lines 18-19, reads "capable or either, destroying only the functionality of the articles or, fully" – both commas need to be removed.

Column 8,
Line 2, reads "thereby by allowing" and should read -- thereby allowing --.
Line 47, reads "falls opens" and should read -- falls open --.

Signed and Sealed this

Twenty-third Day of March, 2004

JON W. DUDAS
*Acting Director of the United States Patent and Trademark Office*